US011001793B2

(12) United States Patent
Piorkowski

(10) Patent No.: US 11,001,793 B2
(45) Date of Patent: May 11, 2021

(54) DETERGENT SINGLE DOSE PACKS AND METHODS OF PRODUCING THE SAME

(71) Applicant: Henkel IP & Holding GmbH, Duesseldorf (DE)

(72) Inventor: Daniel Thomas Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 13 days.

(21) Appl. No.: 15/912,069

(22) Filed: Mar. 5, 2018

(65) Prior Publication Data

US 2019/0270953 A1 Sep. 5, 2019

(51) Int. Cl.

| | |
|---|---|
| ***C11D 17/04*** | (2006.01) |
| ***C11D 3/20*** | (2006.01) |
| ***C11D 3/22*** | (2006.01) |
| ***C11D 3/43*** | (2006.01) |
| ***C11D 3/10*** | (2006.01) |
| ***C11D 3/37*** | (2006.01) |
| ***C11D 11/00*** | (2006.01) |
| ***C11D 3/00*** | (2006.01) |
| ***C11D 3/48*** | (2006.01) |

(52) U.S. Cl.

CPC ..... *C11D 17/045* (2013.01); *C11D 3/0047* (2013.01); *C11D 3/2075* (2013.01); *C11D 3/221* (2013.01); *C11D 3/43* (2013.01); *C11D 3/48* (2013.01)

(58) Field of Classification Search

None

See application file for complete search history.

(56) References Cited

U.S. PATENT DOCUMENTS

| | | | |
|---|---|---|---|
| 6,037,319 | A | 3/2000 | Dickler et al. |
| 7,259,134 | B2 | 8/2007 | Beckholt et al. |
| D714,161 | S | 9/2014 | Crawford et al. |
| 2003/0114332 | A1 | 6/2003 | Ramcharan et al. |
| 2005/0101505 | A1 | 5/2005 | Wood |
| 2011/0112005 | A1 | 5/2011 | Brooker et al. |
| 2012/0135910 | A1 | 5/2012 | Gross et al. |

(Continued)

FOREIGN PATENT DOCUMENTS

WO WO 2017/131799 A1 * 8/2017

*Primary Examiner* — Lorna M Douyon

(74) *Attorney, Agent, or Firm* — Bojuan Deng

(57) ABSTRACT

A single dose pack and methods for producing and using the same are provided. In one embodiment, a multi-chamber single dose pack includes a container composed of a water-soluble film. Further, the container includes two or more separate chambers. The multi-chamber single dose pack further includes a buffering agent encapsulated within at least a first chamber of the two or more separate chambers and a wash composition encapsulated within at least a second chamber of the two or more separate chambers. The wash composition includes a detergent surfactant, water present in an amount of up to about 80 weight percent, based on the total weight of the wash composition, a water activity-reducing salt, carbohydrate, or non-aqueous solvent, and an organic or inorganic acid-based preservative. The wash composition has a water activity of about 0.1 to about 0.9. Further, the wash composition has a pH of about 3.5 to about 5.5.

19 Claims, 1 Drawing Sheet

(56) References Cited

U.S. PATENT DOCUMENTS

| | | | | |
|---|---|---|---|---|
| 2013/0053298 | A1* | 2/2013 | Holzhauer | C11D 1/83<br>510/505 |
| 2014/0274859 | A1 | 9/2014 | Adamy | |
| 2016/0312158 | A1* | 10/2016 | Miracle | C11D 3/349 |
| 2016/0348045 | A1* | 12/2016 | Smith | C11D 17/043 |

* cited by examiner

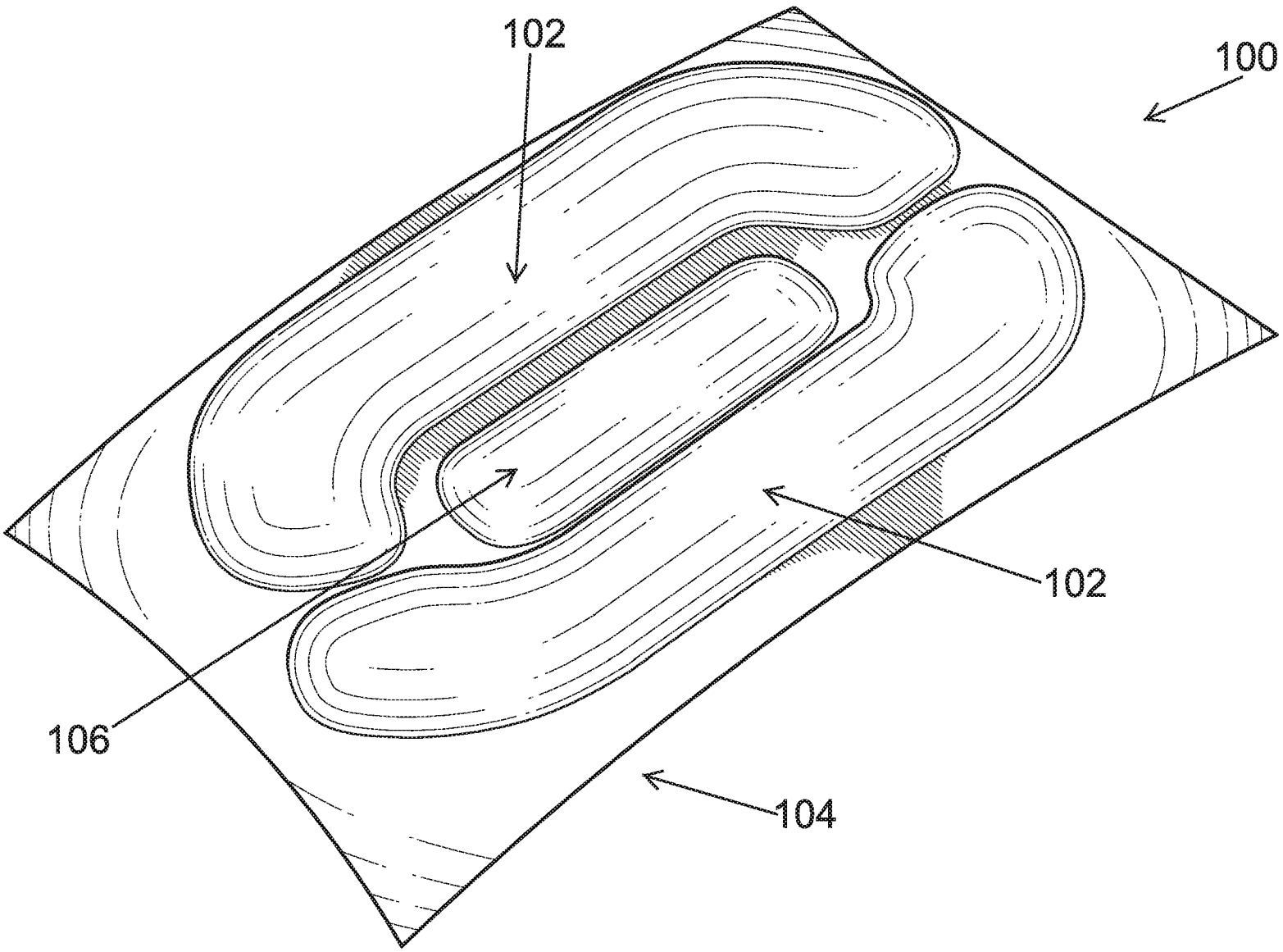
100
102
102
104
106

DETERGENT SINGLE DOSE PACKS AND METHODS OF PRODUCING THE SAME

TECHNICAL FIELD

The technical field relates to detergent packaged in single dose packs and methods of producing the same, and more particularly relates to single dose packs with solvent loadings that are higher than typical and methods of producing the same.

BACKGROUND

Detergent packaged in single dose packs is available for a variety of washing activities, such as clothes laundering and dish washing. The single dose pack provides a premeasured quantity of detergent that is easy to carry and convenient to use. The single dose pack minimizes overdosage of detergent and has proven popular with consumers.

Many single dose packs include a wash composition that is encapsulated within a film, where the wash composition includes detergent, solvents, and other components useful for cleaning. Water is one solvent often utilized in single dose packs. Consumers are accustomed to a standard size of single dose pack, so changes in the wash composition that reduce the total volume may be compensated for by increasing the solvent loading to maintain a more constant single dose pack size.

Moreover, including greater amounts of solvents, such as water and organic solvents, in the wash composition increases the overall size, rigidity, and stability of the single dose pack. The increased size and rigidity results in a single dose pack that is more aesthetically pleasing to handle. Furthermore, increased size and rigidity produces a single dose pack that looks more "full" to consumers, where the single dose pack does not deform or collapse as much during storage.

However, increases in the solvent loading typically result in degradation of the film over time. The film is typically soluble in water, so increases in the water loading have an increased propensity to degrade the film.

With the aforementioned aim of increasing the water content of single dose packs, it is hypothesized that the increased water content may make the packs sensitive to microbiological activity. Microbiological activity in the wash composition has the potential to degrade the wash composition. Additionally, microbiological activity in the wash composition may be undesirably introduced in to the clothes laundering or dishwashing machinery.

Accordingly, it is desirable to provide a single dose pack with increased solvent loading where the film remains structurally sound for extended periods, and methods of producing such single dose packs. Additionally, it is desirable to provide such single dose packs and methods that inhibit microbiological activity. Furthermore, other desirable features and characteristics will become apparent from the subsequent detailed description and the appended claims, taken in conjunction with the accompanying drawings and the foregoing technical field and background.

BRIEF SUMMARY

Single dose packs and methods for producing and using the same are provided. In accordance with one embodiment, a multi-chamber single dose pack includes a container composed of a water-soluble film. Further, the container includes two or more separate chambers. The multi-chamber single dose pack further includes a buffering agent encapsulated within at least a first chamber of the two or more separate chambers and a wash composition encapsulated within at least a second chamber of the two or more separate chambers. The wash composition includes a detergent surfactant, water present in an amount of up to about 80 weight percent, based on the total weight of the wash composition, a water activity-reducing salt, carbohydrate, or non-aqueous solvent, and an organic or inorganic acid-based preservative, provided in either acid form or in salt-of-acid form. The wash composition has a water activity of about 0.1 to about 0.9. Further, the wash composition has a pH of about 3.5 to about 5.5.

In accordance with another embodiment, a method of producing a multi-chamber single dose pack includes providing a wash composition that includes a detergent surfactant, water present in an amount of up to about 80 weight percent, based on the total weight of the wash composition, a water activity-reducing salt, carbohydrate, or non-aqueous solvent, and an organic or inorganic acid-based preservative, provided in either acid form or in salt-of-acid form. The wash composition has a water activity of about 0.1 to about 0.9, and the wash composition has a pH of about 3.5 to about 5.5. The method further includes providing a buffering agent. Still further, the method includes encapsulating the wash composition and the buffering agent each into one or more separate chambers of a container to form the multi-chamber single dose pack, wherein the container is composed of a water-soluble film. Further, the wash composition and the buffering agent do not contact each other while encapsulated within the container.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

DESCRIPTION OF THE DRAWING

A more complete understanding of the subject matter may be derived from the following detailed description taken in conjunction with the accompanying drawing, wherein:

The drawing illustrates an exemplary, multi-chamber single dose pack in accordance with embodiments of the present disclosure.

DETAILED DESCRIPTION

The following detailed description is merely exemplary in nature and is not intended to limit the single dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

The present disclosure generally relates to unit (single) dose wash compositions, contained within single dose packs, that achieve a relatively high water inclusion, while preventing against film degradation during storage as well as possible microbiological activity. In particular, the wash compositions of the present disclosure may include up to about 80% total water, such as from about 15% to about 80% total water, from about 25% to about 80% total water, or from about 30% to about 70% total water, by weight of the overall wash composition. In accordance with the present disclosure, the relatively high water inclusion is achieved by maintaining the water activity of the wash composition about 0.1 to about 0.9, such as below about 0.85. (Water activity ($a_w$) is the partial vapor pressure of water in the wash composition divided by the standard state partial vapor pressure of water.)

In some embodiments, the wash compositions of the present disclosure incorporate a salt, including but not limited to sodium chloride and/or sodium citrate, for the purpose of reducing the water activity of the wash composition to about 0.1 to about 0.9. In other embodiments, materials such as carbohydrates, including but not limited to sucrose, glucose, fructose, and/or various syrups can be utilized alone or in additional to the salt for the purpose of reducing the water activity of the wash composition to about 0.1 to about 0.9. In still other embodiments, materials such as non-aqueous solvents, including but not limited to polyethylene glycol and ethylene oxide/propylene oxide block co-polymers. The reduced water activity of the wash composition enables it to have a similar interaction with the encapsulating film as a traditional, low-water product behaves.

With such an increased water content of the wash composition, however, it has been hypothesized that microbiological activity may be observed in the wash composition. That is, it may be possible that by increasing the water content of the wash composition, it may become microbiologically sensitive. Traditional preservatives used in wash compositions, including for example methylisothiazolinone (MIT) and benzisothiazolinone (BIT) are effective at neutral to high pH. However, the use of such traditional preservatives may be undesirable in some instances, for example at lower pHs. Other organic or inorganic acid-based preservatives, including but not limited to sorbic acid and benzoic acid (or their salts), are most effective below a pH of about 5.5. Wash compositions, however, typically avoid acidic pHs, due to possible adverse effects on the items being washed (clothes, dishes, etc.).

Accordingly, embodiments of the present disclosure utilize a multi-chamber single dose pack configuration, wherein the multi-chamber single dose pack includes a plurality of individual, separately sealed (by the film) chambers. In at least one of the plurality of chambers, as wash composition is encapsulated that includes a relatively high amount of water (for example, up to about 80% by weight of the overall wash composition), an organic or inorganic acid-based preservative (such as sorbic acid or benzoic acid, or their salts), wherein the wash composition is at a pH of at or below about 5.5, at or below about 5.0, or about or below about 4.6, such as a pH range of about 3.5 to about 5.5, or about 3.5 to about 5.0, or about 3.5 to about 4.6. In other embodiments, the pH range may be from about 3.5 to about 4.0, or about 4.0 to about 4.6, or about 4.6 to about 5.0, or about 5.0 to about 5.5. In at least one other of the plurality of chambers, a buffering agent is encapsulated that is capable of neutralizing the pH of the wash liquor within the washing machine when both the wash composition and the buffering agent are dissolved in the wash liquor. The buffering agent may be an organic salt, including but not limited to sodium citrate and/or potassium citrate (in any of the tri-, di-, or mono-salt forms). Alternatively or additionally, the buffering agent may be provided as sodium, calcium, or potassium salts of citrate, malate, succinate, acetate, adipate, tartrate, fumarate, phosphate, lactate, or carbonate, or combinations thereof (in any of the tri-, di-, or mono-salt forms). The buffering agent may be provided in a powdered form or in a liquid form, either as a pure liquid or pre-dissolved into a liquid. The multi-chamber pack is configured such that the wash composition and the buffering agent do not interact with one another until the film dissolved into the wash liquor within the washing machine, thus allowing the wash composition to maintain a pH at or below about 5.5, such as about 3.5 to about 5.5, until the single dose pack is used for washing.

In accordance with the present disclosure, it is desirable to provide a wash composition with a relatively acidic pH, as noted above, preferably at or below 5.5, such as about 3.5 to about 5.5. Various advantages are attendant with the maintenance of an acidic pH. For example, wash compositions in accordance with present disclosure may be stable during long periods of storage (i.e., several months or more), wherein stability refers to the tendency of the composition to maintain a homogeneous form. Further, wash compositions in accordance with the present disclosure may allow the acid-based preservatives to be present in a relatively high concentration (such as greater than about 50%) in their undissociated form, which is the active preservative form. Still further, the disclosed wash compositions at the disclosed acidic pH range may have desirable anti-microbiological functions.

With reference now to the drawing, a multi-chamber single dose pack 100 is formed by encapsulating a wash composition 102 and a buffering agent 106 separately within a container 104, where the container 104 includes a film. The container 104 seals the wash composition 102 in one or more chambers separately from the buffering agent 106, which itself is encapsulated in one or more chambers. As illustrated in the drawing, the wash composition 102 is provided in two chambers, which generally surround a third chamber including the buffering agent 106. However, it should be appreciated that any multi-chamber configuration (including any number of chambers) of the container 104 is possible that allows for the inclusion of sufficient amounts of both the wash composition 102 and the buffering agent 106. More specifically, the disclosure is not limited to the embodiment of the drawing, wherein the two liquid chambers are symmetrical and enclose a powder chamber. The disclosure also covers a unit dose pack with two chambers, or more than three chambers, and chambers with different configurations, shapes, and sizes, for example.

The film of container 104 is water soluble such that the film will completely dissolve when an exterior of the film is exposed to water, such as in a washing machine typically used for laundry or dishes. When the film dissolves, the container 104 is ruptured and the contents, including the wash composition 102 and the buffering agent 106, are released. As used herein, "water soluble" means at least 2 grams of the solute (the film in one example) will dissolve in 5 liters of solvent (water in one example) for a solubility of at least 0.4 grams per liter (g/1), at a temperature of 25 degrees Celsius (° C.) unless otherwise specified. Suitable films for packaging are completely soluble in water at temperatures of about 5° C. or greater.

The film is desirably strong, flexible, shock resistant, and non-tacky during storage at both high and low temperatures and high and low humidities. In an exemplary embodiment, the film is initially formed from polyvinyl acetate, and at least a portion of the acetate functional groups are hydrolyzed to produce alcohol groups. Therefore, the film includes polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide, but the film is water soluble in all embodiments.

In in some embodiments, the container 104 may include multiple chambers wherein each chamber is composed of different PVOH films such that the contents of each chamber may be dissolved in the wash liquor in a step-wise fashion at different times. In this manner, when in use, the buffering agent 106, for example, may be released first, then the wash composition 102 subsequently, or vice versa. Alternatively, in other embodiments, the buffering agent 106 and the wash composition 102 are provided in two chambers partitioned or separated by a common film wall. The common film wall is made of a material that is more prone to dissolution than the material that is used to construct the outside film of the unit dose pack. Thus, the common film is more prone to dissolution than the outside film when they are exposed to a large quantity of water. In this manner, when in use and upon immersing in the wash water, the common film wall dissolves first, mixing the buffering agent and the wash composition so as to neutralize it, before the outside films dissolve to release the entire contents in a washing machine. This embodiment of the single dose pack is advantageous because it provides a low pH environment to effectively inhibit microbiological activity of the wash composition during storage, while it enables the low pH detergent composition to behave like a neutral pH detergent by neutralizing the detergent composition when in use by neutralizing the low pH detergent before dissolving the pack into the wash water.

The wash composition 102 and the buffering agent 106 are positioned separately within the container 104, and the container 104 is sealed to encase and enclose the wash composition 102 separately from the buffering agent 106. The wash composition 102 and the buffering agent 106 are typically in direct contact with the film of the container 104 within the multi-chamber single dose pack 100. The film of the container 104 is sealable by heat, heat and water, ultrasonic methods, or other techniques, and one or more sealing techniques may be used to enclose the wash composition 102 and the buffering agent 106 within the container 104.

In an exemplary embodiment, the wash composition 102 is liquid when encapsulated within the container 104, and the buffering agent 106 is in powdered form when encapsulated within the container 104. In an alternative embodiment, the wash composition 102 is liquid when encapsulated within container 104, and the buffering agent 106 is also in liquid form when encapsulated within the container 104. The liquid wash composition 102 may have a viscosity of from about 50 to about 2,500 centipoise, or from about 100 to about 500 centipoise in different embodiments, where "viscosity," as used herein, means the viscosity measured by a rotational viscometer at a temperature of 25 degrees Celsius (° C.). The liquid form facilitates rapid delivery and dispersion of the wash composition once the container 104 ruptures, and this rapid dispersion can aid cleaning. The powdered buffering agent 106 may have powder granules of any suitable size, or the liquid buffering agent 106 may have any suitable viscosity.

In an exemplary embodiment, the single dose pack 100 is sized to provide a desired quantity of wash composition 102 and buffering agent 106 for one load of laundry or one batch of dishes in a dishwasher. The single dose pack 100 may also be sized for a fraction of a desired quantity, such as one half of a load of laundry, so a user can adjust the amount of detergent added without having to split a single dose pack 100. In an exemplary embodiment, the single dose pack 100 (including the container 104, the wash composition 102, and the buffering agent 106) has a weight of from about 15 to about 50 grams. In alternate embodiments, the single dose pack 100 is from about 15 to about 40 grams, or from about 17 to about 30 grams.

A multi-chamber single dose pack 100 that includes a wash composition 102 with the relatively high water levels, such as up to about 80% by weight of the overall wash composition, as described herein may be more likely to have favorable pack haptics, film stability, and desirable dissolution rates. A percent pack height loss is a ratio of a change in pack height (original pack height minus a final pack height after storage) to the original pack height. Single dose packs tend to lose some pack height with storage, and the percent pack height loss is a good indication of the haptics of the pack. A single dose pack 100 with a low percent pack height loss has a more appealing appearance to a user, where a package with several single dose packs looks fuller and each single dose pack 100 appears fresher and more appealing. The concentration of water as described herein has a significant effect on the percent pack height loss. As such, as noted above, it is desirable to increase the amount of water relative to prior wash compositions. The % pack height loss, as described herein, is based on a storage time of about 2 months at a storage temperature of about 24° C.

A plurality of components are combined to form a wash composition 102, where the wash composition 102 is typically prepared prior to encapsulation within the container 104. The plurality of components include water, and as mentioned above the film is soluble in water. The film remains structurally sound and intact prior to use of the single dose pack 100, where the single dose pack 100 is immersed in a large quantity of water in use. A "large" quantity of water is at least about 100 times the weight of the single dose pack 100. For example, a single dose pack 100 having a weight of from about 5 to about 50 grams may be immersed in from about 5 to about 50 liters of water in use. As used herein, "structurally sound" means the container 104 and the film do not rupture or leak under typical storage conditions, such as about 0.5 to about 1.5 atmospheres of pressure, temperatures of about −10 to about 35° C., and a relative humidity of about 1 to about 80% for a period of at least 1 week. Structurally sound also means the container 104 and the film are not tacky or sticky to the touch.

Water is included in the wash composition 102 at a concentration of up to about 80% total water, such as from about 15% to about 80% total water, from about 25% to about 80% total water, from about 40% to about 80% total water, from about 30% to about 70% total water, from about 15% to about 65% total water, or from about 15% to about 50% total water, by weight of the overall wash composition 102. In other embodiments, water is included in the wash composition 102 at a concentration of about 15% to about 30%, about 30% to about 45%, about 45% to about 60%, or about 60% to about 80% total water, by weight of the overall wash composition. Water may be added to the wash composition 102 directly or as a component of other ingredients, or directly and as a component of other ingredients.

The wash composition 102 has a water activity of at or below about 0.9, for example at or below about 0.85, such as about 0.1 to about 0.9, or about 0.1 to about 0.85, and preferably about 0.6 to about 0.9, or about 0.6 to about 0.85. In other embodiments, the water activity of the wash composition may be from about 0.6 to about 0.7, from about 0.7 to about 0.8, from about 0.8 to about 0.85, or from about 0.85 to about 0.9. A water activity-reducing agent, such as a salt, a carbohydrate, or a non-aqueous solvent may be used for this purpose.

In some embodiments, the wash composition 102 of the present disclosure incorporates a water activity-reducing salt, including but not limited to sodium chloride and/or sodium citrate, for the purpose of reducing the water activity of the wash composition 102 to about 0.1 to about 0.9. In other embodiments, the water activity-reducing salt may be provided as sodium, calcium, or potassium salts of citrate, malate, or lactate, or combinations thereof, for this purpose.

In other embodiments, materials such as carbohydrates, including but not limited to sucrose, glucose, and/or fructose, can be utilized alone or in additional to the salt for the purpose of reducing the water activity of the wash composition 102 to about 0.1 to about 0.9. Other suitable carbohydrates, in some embodiments, may alternatively or additionally include xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof. Further suitable carbohydrates, in some embodiments, may alternatively or additionally include high-fructose corn syrup (HCFS). HFCS typically refers to a blend of approximately 23% water and 77% saccharide. For example, HFCS 55 typically refers to a blend of water (about 23%), glucose (about 34%), and fructose (about 42%). However, in a dried form, HFCS 55 contains approximately 55% fructose by weight of dry HFCS. Unless otherwise stated, HFCS used herein refers to a wet blend which contains water, as it is supplied from HFCS manufacturers. However, it should be understood that dry or essentially dry hybrid of monosaccharides (e.g. HFCS), wherein water has been removed partially or completely, can also be used. Other carbohydrate syrups that may be used include light corn syrup (fructose), glucose syrup, and sucrose syrup.

In still other embodiments, materials such as non-aqueous solvents, such as relatively low molecular weight polyethylene glycols (PEGs) may be employed as water activity reducing agents. As conventionally used in the art, the use of PEG alone, not followed by a number, refers to PEG with all possible molecular weight (MW). The use of PEG with a specific number, for example, "PEG 400", indicates that that PEG having a weight average molecular weight of about 400, for example having MW ranging from about 380 to about 420. The relatively low molecular weight PEG used as suitable non-aqueous solvents refers to PEG having a weight average MW of about 600 Daltons or less. Suitable relatively lower MW PEGs may include those having a weight average molecular weight of PEG 200, PEG 250, PEG 300, PEG 350, PEG 400, PEG 450, PEG 500, PEG 550, and/or PEG 600 Daltons. Other suitable non-aqueous solvents include ethylene oxide/propylene oxide block co-polymers.

In various embodiments, the water activity-reducing agent may include two or more of: salts, carbohydrates, and non-aqueous solvents, in combination. In some embodiments, however, the water-activity reducing agent is limited to the aforementioned salts, but no carbohydrate and no non-aqueous solvent. In other embodiments, the water activity-reducing agent is limited to a carbohydrate, but no salt, and optionally a non-aqueous solvent. In still further embodiments, the water activity-reducing agent is limited to a non-aqueous solvent, but no salt or carbohydrate.

The amount of water activity-reducing salt, carbohydrate, and/or non-aqueous solvent required for this purpose various based on the exact compound(s) employed, but is generally from about 5% to about 25%, or from about 5% to about 20%, or from about 5% to about 15%, for example from about 10% to about 25%, or about 10% to about 20%, by weight of the overall wash composition 102. In other embodiments, the amount of water activity-reducing salt, carbohydrate, and/or non-aqueous employed is from about 5% to about 10%, or about 10% to about 15%, or about 15% to about 20%, or about 20% to about 25%, by weight of the overall wash composition 102.

Besides the water activity-reducing non-aqueous solvents noted above, if present, the wash composition 102 may optionally include additional non-aqueous solvents. For example, non-aqueous solvents that may be included in the wash composition 102 are glycerol, propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl) methyl ammonium methylsulfate; ethylene oxide/propylene oxide copolymers with a number average molecular weight of 3,500 Daltons or less; and ethoxylated fatty acids. The non-aqueous solvents, if present, may be included in the wash composition 102 in an amount of from about 1% to about 50%, such as from about 5% to about 45%, or about 10% to about 40%, or about 15% to about 35%, or about 5% to about 40%, or about 5% to about 30%, by weight of the overall wash composition 102. In other embodiments, the non-aqueous solvents, if present, may be included in the wash composition 102 in an amount of from about 1% to about 5%, or about 5% to about 10%, or about 10% to about 15%, or about 15% to about 20%, or about 20% to about 25%, or about 25% to about 30%, or about 30% to about 35%, or about 35% to about 40%, or about 40% to about 45%, or about 45% to about 50%, by weight of the overall wash composition 102.

The wash composition 102 includes one or more organic or inorganic acid-based preservatives. Suitable organic or inorganic acid-based preservatives include, but are not limited to, sorbic acid and benzoic acid. The organic or inorganic acid-based preservative may alternatively be provided in salt-of-acid form, for example sodium sorbate, sodium benzoate, potassium sorbate, or potassium benzoate. If the organic or inorganic acid-based preservative is provided in the form of the salt of the acid, then an additional acid may be included in the wash composition to reduce the pH of the wash composition to at or below about 5.5, such as about 3.5 to about 5.5, thereby providing a relatively high percentage (such as greater than about 50%) of the undissociated organic acid in the wash composition 102, which is the percentage that has active preservative properties. A suitable acid for this purpose includes, for example, lactic acid.

The organic or inorganic acid-based preservative may be included in the wash composition in an amount of about 0.01% to about 0.50%, such as about 0.02% to about 0.25%, or from about 0.05% to about 0.20%, by weight of the overall wash composition. When the additional acid is included, such additional acid may be present in the wash composition 102 in an amount that ranges anywhere from about 50% to about 150% of the weight of the salt of the organic or inorganic acid-based preservative, such as about 75% to about 125% of the weight of the salt of the organic or inorganic acid-based preservative. Furthermore, when the additional acid is included, it may be preferable to the preservative to the wash composition 102 at a neutral pH, dissolve the salt, then lower the pH of the wash composition 102 below the desired pH level, such as below a pH of about 5.5. The reason for doing so is that it may be difficult to add a salt version of the preservative to a low pH system because it may form unstable flocculations, in some instances. The wash composition may avoid the use of (not include) MIT and BIT preservatives.

The wash composition 102 may include other components as well. For example, the wash composition 102 may include an ionic detergent surfactant, where the ionic detergent surfactant is formulated for laundry in an exemplary embodiment. The ionic detergent surfactant may include one or more surfactants, including cationic and/or anionic surfactants, in various embodiments. The ionic detergent surfactant may be present in the wash composition 102 at a concentration of from about 5 to about 55 weight percent in one embodiment, but the ionic detergent surfactant may be present in the wash composition 102 at a concentration of about 10 to about 30 weight percent or from about 20 to about 25 weight percent in alternate embodiments, where weight percents are based on a total weight of the wash composition 102.

Suitable ionic detergent surfactants that are anionic include soaps which contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable ionic detergent surfactants of the sulfate type include the salts of sulfuric acid semi esters of fatty alcohols with 12 to 18 C atoms, and/or alcohol ethoxysulfates. Usable ionic detergent surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

Suitable ionic detergent surfactants that are cationic may include textile-softening substances of the general formula X, XI, or XII as illustrated below:

(X)

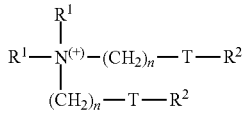

(XI)

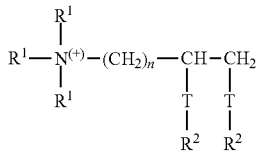

(XII)

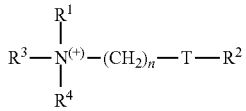

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$═$R^1$ or $(CH_2)_n$-T-$R^2$; $R^4$═$R^1$ or $R^2$ or $(CH_2)_n$-T-$R^2$; T-═$CH_2$—, —O—CO—, or —CO—O—, and n is an integer from 0 to 5. The ionic detergent surfactants that are cationic may include conventional anions of a nature and number required for charge balancing. Alternatively, the ionic detergent surfactant may include anionic detergent surfactants that may function to balance the charges with the cationic detergent surfactants. In some embodiments, ionic detergent surfactants that are cations may include hydroxyalkyltrialkylammonium compounds, such as $C_{12-18}$ alkyl(hydroxyethyl) dimethyl ammonium compounds, and may include the halides thereof, such as chlorides or other halides. The ionic detergent surfactants that are cations may be especially useful for compositions intended for treating textiles.

In some embodiments, the anionic surfactant is a polyethoxylated alcohol sulfate, such as those sold under the trade name CALFOAM® 303 (Pilot Chemical Company, Calif.). Such materials, also known as alkyl ether sulfates (AES) or alkyl polyethoxylate sulfates, are those which correspond to the following formula (XIII):

R'—O—(C2H4O)*n*-SO3M' (XIII)

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium. In another embodiment, R' is a C12-C16 alkyl, n is from 1 to 6 and M' is sodium. In another embodiment, the alkyl ether sulfate is sodium lauryl ether sulphate (SLES).

In some embodiments, the anionic surfactant can be linear alkylbenzene sulfonic acid (LAS) or a salt thereof, alkyl ethoxylated sulphate, alkyl propoxy sulphate, alkyl sulphate, or a mixture thereof. Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

However, in other embodiments, the liquid compositions are substantially free of LAS. In other embodiments, the liquid compositions are substantially free of a sulfate surfactant.

Nonionic detergent surfactants may optionally be present in the wash composition at a concentration of from about 0 to about 60 weight percent, or from about 5 to about 50 weight percent, or from about 10 to about 30 weight percent, or from about 20 to about 40 weight percent in various embodiments. Suitable nonionic detergent surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (XIV):

$$R_2—(—O—C_2H_4—)_m—OH \quad \text{(XIV)}$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE is Tomadol® 25-7 (available from Air Product). Other suitable AEs include Genapol® $C_{200}$ (available from Clariant), which is a coco alcohol having an average degree of ethoxylation of 20.

Several other components may optionally be added to and included in the wash composition 102, including but not limited to enzymes, peroxy compounds, bleach activators, anti-redeposition agents, optical brighteners, foam inhibitors, chelators, buttering agents, dye transfer inhibitors, soil release agents, water softeners, and other components. A partial, non-exclusive list of additional components (not illustrated) that may be added to and included in the wash composition 102 include electrolytes, pH regulators, graying inhibitors, anti-crease components, bleach agents, colorants, scents, and processing aids.

Possible enzymes that may be in the wash composition 102 contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) should be compatible with the selected wash composition 102, (i.e., pH-optimum, compatibility with other enzymatic and non-enzymatic ingredients, etc.). The detergent enzyme(s) may be included in the wash composition 102 by adding separate additives containing one or more enzymes, or by adding a combined additive comprising all the enzymes that are added to the wash composition 102. Suitable enzyme additives are solutions that are about 10% active, such as about 7% to about 13% active. These enzyme solutions should be present in the wash composition 102 in effective amounts, such as from about 0 weight percent to about 5 weight percent of enzyme, or from about 0.001 to about 1 weight percent, or from about 0.2 to about 2 weight percent, or from about 0.5 to about 1 weight percent, based on the total weight of the wash composition 102, in various embodiments. In other embodiments, enzymes can be added in a powder form, such as in a granular form.

As alluded to above, a peroxy compound may optionally be present in the wash composition 102. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition 102 at an amount of from about 0 to about 50 weight percent, or an amount of from about 3 to about 30 weight percent, or an amount of from about 3 to about 10 weight percent, based on the total weight of the wash composition 102, in various embodiments.

Bleach activators may optionally be added and included in the wash composition 102. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition 102, in a known manner. As such, the bleach activator and/or other components may be present in a liquid wash composition 102 as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In various embodiments, the bleach activators may be present in the wash composition 102 in quantities of from about 0 to about 8 weight percent, or from about 0 to about 6 weight percent, or from about 0 to about 4 weight percent, in each case relative to the total weight of the wash composition 102.

One or more anti-redeposition agents may also be optionally included in the wash composition 102. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—$(CHR^{11}—)$aOH, which may also be present as a polymeric diol H—$(O—(CHR^{11}—)_a)_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—$(CHR^{11}—)_a$O— but also polymer diol units —$(O—(CHR^{11}—)_a)_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—$(CHR^{11}—)_a$OH include those in which $R^H$ is hydrogen and "a" is a number of from about 2 to about 6, and in another embodiment includes those in which "a" has the value of 2 and $R^H$ is selected from hydrogen and alkyl residues with 1 to 10 C atoms, or where $R^H$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition 102 at an amount of from about 0 to about 3 weight percent, or an amount of from about 0 to about 2 weight percent, or an amount of from about 0 to about 1 weight percent, based on the total weight of the wash composition 102, in various embodiments.

Optical brighteners may optionally be included in the wash composition 102. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl) diphenyl. Mixtures of the above-stated optical brighteners may also be used. Optical brighteners may be present in the wash composition 102 at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the wash composition 102.

Foam inhibitors may also optionally be included in the wash composition 102. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The wash composition 102 may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the wash composition 102.

Chelators bind and remove calcium, magnesium, or other metals from water, and may optionally be included in the wash composition 102. Many compounds can be used as water softeners, including but not limited to ethylenediaminetetraacetic acid (EDTA), nitrilotriacetic acid, diethylenetriaminepenta(methylenephosphonic acid), nitrilotris (methylenephosphonic acid), 1-hydroxyethane-1,1-diphosphonic acid, iminodisuccinic acid (IDS), or other chelating agents. Chelators may be present in the wash composition 102 at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the wash composition 102.

Bittering agents may optionally be added to hinder accidental ingestion of the single dose pack 100 or the wash composition 102. Bittering agents are compositions that taste bad, so children or others are discouraged from accidental ingestion. Exemplary bittering agents include denatonium benzoate, aloin, and others. Bittering agents may be present in the wash composition 102 at an amount of from about 0 to about 1 weight percent, or an amount of from about 0 to about 0.5 weight percent, or an amount of from about 0 to about 0.1 weight percent in various embodiments, based on the total weight of the wash composition 102.

The total weight of the wash composition 102 in the multi-chamber single dose pack 100 may be from about 10 grams to about 40 grams, such as from about 15 grams to about 30 grams, or from about 15 grams to about 25 grams. The total weight of the buffering agent, as described above, may be from about 1.0 gram to about 4.0 grams, such as from about 1.5 grams to about 3.5 grams, or about 2.0 grams to about 3.0 grams. As such, a weight ratio may be defined for the amount of wash composition in the single dose pack 100 to the amount of buffering agent in the single dose pack 100, wherein such ratio is from about 40:1 to about 40:16, such as from about 40:2 to about 40:12, or from about 40:3 to about 40:8.

The components of the wash composition 102 are combined and mixed together with a mixer. Once mixed, the wash composition 102 is encapsulated in the container 104, as described above. The components of the wash composition 102 may all be mixed at one time, or different components may be pre-mixed and then combined. A wide variety of mixers may be used in alternate embodiments, such as an agitator, an in-line mixer, a ribbon blender, an emulsifier, and others. The wash composition 102 is placed in one or more chambers of the container 104. Moreover, as noted above, the buffering agent 106 is placed in one or more chambers of the container 104. Then, the film of the container 104 is sealed with a sealer, where the sealer may utilize heat, water, ultrasonic techniques, water and heat, pressure, or other techniques for sealing the container 104 and forming the multi-chamber single dose pack 100.

Another exemplary embodiment is also directed to the use of a multi-chamber single dose pack 100 as described above in a cleaning process such as laundry and/or hard surface cleaning. In particular, an embodiment is directed to the use of a single dose pack 100 in laundering of textile and fabrics, such as house hold laundry washing and industrial laundry washing. A further exemplary embodiment is directed to the use of a single dose pack 100 in hard surface cleaning such as automated dish washing (ADW), car washing, and the cleaning of industrial surfaces.

The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the multi-chamber single dose pack 100 is also added to the washing machine before wash water is added. In an alternate embodiment, the single dose pack 100 may be added to an automatic detergent addition system of a washing machine, where the contents of the single dose pack 100 are added to the wash water with the fabrics and/or garments after the washing process has begun. In yet another embodiment, the single dose pack 100 is manually added to the fabrics and/or garments with the wash water after the washing process has started. The film dissolves and releases the wash composition 102 and the buffering agent 106 into the aqueous wash water. The film is dissolved and washes out of the washing machine with the excess wash water, so there is nothing to collect from the fabrics and/or garments after the wash cycle. The fabrics and/or garments are laundered with the wash water and the contents of the single dose pack 100. The fabrics and/or garments may then be dried and processed as normal.

In an alternate embodiment, the multi-chamber single dose pack 100 is added to a detergent charging system for an automatic dish washing machine. The detergent charging system opens and releases the single dose pack 100 to the wash water and a main compartment of the dish washing machine at a designated point in the wash cycle.

ILLUSTRATIVE EXAMPLES

The present disclosure is now illustrated by the following non-limiting examples. It should be noted that various changes and modifications can be applied to the following examples and processes without departing from the scope of this disclosure, which is defined in the appended claims. Therefore, it should be noted that the following examples should be interpreted as illustrative only and not limiting in any sense.

Three different wash compositions were prepared according to the foregoing description. Composition 1 is a control composition that does not include any acid or preservative. Composition 1 includes, by weight-%, added water in an amount of 54.6% (total water in Composition 1 is 57.9%, due to the inclusion of water in some of the other ingredients, as noted below), sodium chloride in an amount of 15.4% to reduce the water activity of the composition to about 0.1 to about 0.9, 15% of a non-ionic surfactant, and 15% of an anionic surfactant (65% active, 22% water). Composition 2 is the same as Composition 1, but with the inclusion of 0.06% lactic acid (88%) to reduce the pH of the composition (added water is therefore reduced to 54.54%). Composition 3, in accordance with an embodiment of the present disclosure, is the same as Composition 2, but with the inclusion of 0.05% sodium benzoate, which is the salt of an organic acid preservative (benzoic acid) as described herein (added water is therefore reduced to 54.49%). Compositions 1-3 are set forth in TABLE 1, below.

TABLE 1

| Composition # | 1 | 2 | 3 |
|---|---|---|---|
| | — | — | — |
| Added Water | 54.6 | 54.54 | 54.49 |
| Sodium Benzoate | 0 | 0 | 0.05 |
| Sodium Chloride | 15.4 | 15.4 | 15.4 |
| Lactic Acid (88%) | 0 | 0.06 | 0.06 |
| Non-Ionic Surfactant | 15 | 15 | 15 |
| Anionic Surfactant (65% Active, 22% Water) | 15 | 15 | 15 |
| | — | — | — |
| Total Water Content (%) | 57.9 | 57.84 | 57.79 |
| Approx. % Surfactant | 25% | 25% | 25% |
| | — | — | — |
| Total Formula (%) | 100 | 100 | 100 |
| | — | — | — |

TABLE 1-continued

| Composition # | 1 | 2 | 3 |
|---|---|---|---|
| pH of the wash composition alone | 6.64 | 4.28 | 4.38 |
| pH when the wash composition is dissolved in de-ionized water (at 22 grams per 13 L) | 5.83 | 5.34 | 5.38 |
| pH when the wash composition and sodium citrate is dissolved in de-ionized water (at 22 grams of the wash composition plus 2.5 grams of Sodium Citrate per 13 L) | 7.55 | 7.58 | 7.54 |

As demonstrated in TABLE 1, the pH of each composition was then determined. Composition 1, without any added acid, had a relatively neutral pH of 6.64. Compositions 2 and 3, with the added lactic acid, had relatively acidic pHs of 4.28 and 4.38, respectively, which is below the pH of about 4.6, required for good activity of the organic or inorganic acid-based preservative. As further demonstrated in TABLE 1, each composition was dissolved in de-ionized water at a concentration of 22 grams per 13 liters, which is substantially equivalent to typical high-efficiency front-loading washing machine concentrations (of the wash liquor). The pH of the resulting wash liquor was then determined under two conditions: (1) without any buffer added, and (2) with 2.5 grams of sodium citrate added as a buffering agent. As can be seen, the inventive wash Composition 3 achieves a relatively neutral pH of 7.54 when the buffering agent is added, which is very similar to the pH achieved by both Compositions 1 and 2.

As such, in accordance with the present disclosure, by creating a single dose product with a buffer (in either powder or liquid form) in one compartment and another compartment of low pH wash composition, a formulator can use a multi-chamber product to enable the use of preservatives such as benzoic acid or sorbic acid and avoid the use of MIT/BIT and other preservatives commonly used by the industry. Upon dissolution, the wash water (liquor) pH will be about the same for the low pH multi-chamber pack as it would for a neutral pH single or multi-chamber pack.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A multi-chamber single dose pack comprising:

a container composed of a water-soluble film, and wherein the container comprises two or more separate chambers;

a buffering agent encapsulated within at least a first chamber of the two or more separate chambers; and a wash composition encapsulated within at least a second chamber of the two or more separate chambers, wherein the wash composition comprises:

a detergent surfactant;

water present in an amount of up to about 80 weight percent, based on the total weight of the wash composition;

a water activity-reducing salt, carbohydrate, or non-aqueous solvent; and an organic or inorganic acid-based preservative, provided in either acid form or in salt-of-acid form, wherein the wash composition has a water activity of about 0.1 to about 0.9 wherein the organic or inorganic acid-based preservative is in an amount sufficient to make the wash composition to have a pH of about 3.5 to about 5.5 and;

wherein the buffering agent and the wash composition are provided in two chambers separated by a common film wall;

wherein the common film wall is made of a material that is more prone to dissolution than a material which is used to construct an outer film of the single dose pack, such that when immersed in a wash water, the common film wall dissolves first, mixing the buffering agent and the wash composition first, before the outside film dissolves;

wherein the mixing the buffering agent and the wash composition causes the pH of the wash composition to increase to a neutral pH before dissolving into wash water.

2. The multi-chamber single dose pack of claim 1, wherein the organic or inorganic acid-based preservative is selected from the group consisting of lactic acid, sorbic acid, benzoic acid, sodium sorbate, potassium sorbate, sodium benzoate, and potassium benzoate.

3. The multi-chamber single dose pack of claim 1, wherein the organic or inorganic acid-based preservative is lactic acid.

4. The multi-chamber single dose pack of claim 1, wherein the film seals the two or more separate chambers such that the buffering agent and the wash composition do not contact each other prior to dissolution of the film.

5. The multi-chamber single dose pack of claim 1, wherein the water-soluble film comprises polyvinyl alcohol (PVOH).

6. The multi-chamber single dose pack of claim 1, wherein the buffering agent is selected from the group consisting of: sodium, calcium, or potassium salts of citrate, malate, succinate, acetate, adipate, tartrate, fumarate, phosphate, lactate, and carbonate, and combinations thereof.

7. The multi-chamber single dose pack of claim 1, wherein the buffering agent is in a powdered form or in a liquid form.

8. The multi-chamber single dose pack of claim 1, wherein the buffering agent is present in the container in an amount of from about 1.0 gram to about 4.0 grams; and wherein the total weight of the wash composition is an amount from about 10 grams to about 40 grams.

9. The multi-chamber single dose pack of claim 1, wherein the wash composition comprises water in an amount of about 15 to about 80 weight percent, based on the total weight of the wash composition.

10. The multi-chamber single dose pack of claim 1, wherein the wash composition comprises water in an amount of from about 25 to about 80 weight percent, based on the total weight of the wash composition.

11. The multi-chamber single dose pack of claim 1, wherein the wash composition is present in the container in an amount of from about 10 grams to about 40 grams.

12. The multi-chamber single dose pack of claim 1, wherein the water activity-reducing salt is selected from the group consisting of: sodium, calcium, or potassium salts of citrate, malate, and lactate, and combinations thereof; or wherein the water activity-reducing carbohydrate is selected from the group consisting of: sucrose, glucose, fructose, high fructose corn syrup (HFCS), light corn syrup, glucose syrup, and sucrose syrup, and combinations thereof; or wherein the water activity-reducing non-aqueous solvent is selected from the group consisting of: polyethylene glycol and ethylene oxide/propylene oxide block copolymers, and combinations thereof.

13. The multi-chamber single dose pack of claim 1, wherein the water activity-reducing salt, carbohydrate, or non-aqueous solvent is present in the wash composition in an amount of about 5 to about 25 weight percent, based on the total weight of the wash composition.

14. The multi-chamber single dose pack of claim 1, wherein the organic or inorganic acid-based preservative is present in the wash composition in an amount of about 0.01 to about 0.50 weight percent, based on the total weight of the wash composition.

15. The multi-chamber single dose pack of claim 1, wherein the wash composition has a water activity of about 0.6 to about 0.9, and wherein the wash composition has a pH of about 3.5 to about 4.6.

16. The multi-chamber single dose pack of claim 1, wherein the single dose pack is configured for use in a laundry washing machine or a dishwashing machine.

17. A method of producing a multi-chamber single dose pack comprising:

providing a wash composition comprising:

(a) a detergent surfactant;

(b) water present in an amount of up to about 80 weight percent, based on the total weight of the wash composition;

(c) a water activity-reducing salt, carbohydrate, or non-aqueous solvent; and (d) an organic or inorganic acid-based preservative, provided in either acid form or in salt-of-acid form, wherein the wash composition has a water activity of about 0.1 to about 0.9, and wherein the organic or inorganic acid-based preservative is in an amount sufficient to make the wash composition to have a pH of about 3.5 to about 5.5;

providing a buffering agent; and encapsulating the wash composition and the buffering agent each into one or more separate chambers of a container to form the multi-chamber single dose pack, wherein the container is composed of a water-soluble film, and wherein the wash composition and the buffering agent do not contact each other while encapsulated within the container;

wherein the two chambers encapsulating the buffering agent and the wash composition are separated by a common film wall;

wherein the common film wall is made of a material that is more prone to dissolution than a material which is used to construct an outer film of the single dose pack, such that when immersed in a wash water, the common film wall dissolves first, mixing the buffering agent and the wash composition first, before the outside film dissolves;

wherein the mixing the buffering agent and the wash composition causes the pH of the wash composition to increase to a neutral pH before dissolving into wash water.

18. The method of claim 17, wherein the water activity-reducing salt is selected from the group consisting of: sodium, calcium, or potassium salts of citrate, malate, and lactate, and combinations thereof; or wherein the water activity-reducing carbohydrate is selected from the group consisting of: sucrose, glucose, fructose, high fructose corn syrup (HFCS), light corn syrup, glucose syrup, and sucrose syrup, and combinations thereof; or wherein the water activity-reducing non-aqueous solvent is selected from the group consisting of: polyethylene glycol and ethylene oxide/propylene oxide block copolymers, and combinations thereof.

19. The method of claim 17, wherein the organic or inorganic acid-based preservative comprises lactic acid; or wherein the buffering agent is selected from the group consisting of: sodium, calcium, or potassium salts of citrate, malate, succinate, acetate, adipate, tartrate, fumarate, phosphate, lactate, and carbonate, and combinations thereof.

* * * * *